US005887796A

United States Patent [19]

Dimmer

[11] Patent Number: 5,887,796

[45] Date of Patent: Mar. 30, 1999

[54] MULTIPLE DISCHARGE NOZZLE

[76] Inventor: Sylvester J. Dimmer, 1778 S. Rease Rd., CH30, P.O. Box 62, Kingman, Ariz. 86402

[21] Appl. No.: 709,645

[22] Filed: Sep. 9, 1996

[51] Int. Cl.[6] ..... B05B 1/16

[52] U.S. Cl. ..... 239/444; 239/526

[58] Field of Search ..... 239/444, 443, 239/526

[56] References Cited

U.S. PATENT DOCUMENTS

| | | | |
|---|---|---|---|
| 2,342,050 | 2/1944 | Hurst | 239/444 X |
| 2,364,848 | 12/1944 | Hurst | 239/444 |
| 3,799,447 | 3/1974 | Beal | 239/526 X |

FOREIGN PATENT DOCUMENTS

| | | | |
|---|---|---|---|
| 525688 | 9/1940 | United Kingdom | 239/444 |
| 691779 | 5/1953 | United Kingdom | 239/444 |

*Primary Examiner*—Lesley D. Morris
*Attorney, Agent, or Firm*—Gregory J. Nelson

[57] ABSTRACT

A dual mode watering nozzle attachable to a hose. The nozzle has two outlets. One outlet selectively delivers a full flow stream across a valve control. The other outlet selectively delivers a spray. One outlet at the nozzle may be used, for example, to quickly fill a container and the other to deliver a spray for applications such as watering plants or cleaning a surface.

8 Claims, 3 Drawing Sheets

MULTIPLE DISCHARGE NOZZLE

BACKGROUND OF THE INVENTION

Field of the Invention

The present invention relates to a watering apparatus and more particularly relates to a nozzle for attachment to a hose or other water delivery system which nozzle has multiple outlets so that the user may selectively deliver either a full flow stream of water or a variable spray pattern, depending upon the user's requirements.

Nozzles of various types for attachment to hoses such as garden hoses are well known. Some of these nozzles are fixed and others adjustable, allowing the user to adjust the stream of water from a high pressure stream to a spray of varying intensity and angle. Spray nozzles of various types are also known for special applications for the delivery of paints, cleaning solvents and other liquids. A general shortcoming of devices of these types is that while they are effective to deliver a spray, they are not adapted to allow the user to select a full flow water outlet. A full flow water outlet allows the user to discharge fluid in a normal manner without having to remove the spray nozzle which is particularly advantageous if the user is filling a container such as pail or a drum with liquid. In addition, a full flow water outlet is convenient as it allows the nozzle to be threaded to other hoses to be used to deliver full flow of water without first removing the spray nozzle.

Various spray devices, which are represented in the prior art, include the following.

Pacht, U.S. Pat. No. 5,253,808, discloses a power-assisted dump valve on a high pressure spray gun. In particular, the Pacht disclosure shows a high pressure fluid gun with a high pressure nozzle and a discharge orifice. When the handle of the gun is opened, the fluid passes through a valve assembly and through the orifice. When the handle of the gun is closed, the fluid discharges through the high pressure nozzle. The Pacht high pressure gun is designed merely to relieve pressure from a high pressure spray when needed and does not provide a constant full flow output.

Jeffers, U.S. Pat. No. 33,200, discloses a hose nozzle with a swivel head which allows the user to select from two water outputs. This construction allows the user to change nozzles and avoid being sprayed with water.

Nelson, U.S. Pat. No. 4,116,210, shows a faucet spout with a diverter assembly to direct water from the faucet spout to another fixture. This type of device is representative of the devices which are used in tub enclosures to divert water from the tub spout to the shower head.

Levine, U.S. Pat. No. 4,203,551, discloses an apparatus for producing a pulsating spray of water which may be directed to the body of the user. Both the Nelson and Levine patents show the general idea of a spray head and a water diversion means to another location such as a spray shower head.

Battaglia, U.S. Pat. No. 5,160,093 shows a multi-mode watering apparatus. This apparatus has a plurality of water heads and spray heads and the device may be hand-held or ground mounted by means of a foldable spike attached to the body. The valves in the passageway allow the user to divert water to either an omni-directional sprinkler head or to a flared, sectorial or arcuate sprinkler head.

While the above, as indicated, are representative of the prior art and show various diverter valves and multi-positionable watering or fluid delivery devices, none suggest an attachment which may be secured to a hose or conduit and allows the user to select between delivery of a variable spray or a full flow fluid discharge.

BRIEF SUMMARY OF THE INVENTION

Briefly, the present invention provides a fluid delivery device which retains the features of a conventional spray nozzle having a first spray outlet and which also allows the user to selectively discharge fluid at a second outlet at a full flow rate.

The nozzle has a main body having a fluid passageway with an inlet which defines threads for attachment to a hose. The main body is intersected by a generally transverse spray nozzle body having a variable spray nozzle which is selectively actuatable by a pivotal handle secured to the main body of the device. A spray passageway communicates with the main passageway. A pivotal handle operates to selectively position a spray head to deliver the desired spray pattern. The main passageway terminates at a full flow water outlet across a control valve in the main passageway. The full flow outlet can be opened or closed by means of a control valve. Thus, the user can selectively deliver a full flow or a spray stream by selectively operating the spray nozzle handle and the control valve. Preferably the full flow water outlet is provided with a 90° elbow which is either integrally formed as part of the body or is in threaded engagement with the body to allow the full flow and spray nozzle discharge outlets to be generally co-axial. The spray nozzle may also be provided with adjustment means for adjusting the spray and a hook area may be integrally formed in the device to allow the device to be conveniently secured at the edge of a pail or container to free the user's hands while the pail or container is being filled from the full flow outlet or discharge.

BRIEF DESCRIPTION OF THE DRAWINGS

The above and other objects and advantages of the present invention will be more fully understood from the following description, claims and drawings in which:

Turning now to FIG. 1 the drawings, a fluid delivery device or nozzle is generally designated by the numeral 10 and has a main axially-extending body 12. The body 12 defines a passage 14 having an inlet end 16. The inlet end 16 may be provided with suitable means for connecting it to a source of fluid, such as a garden hose. Accordingly, standard female hose threads 18 are provided at the inlet end 16. Passage 14 extends between the inlet end 16 and an outlet end 20. The outlet end 20 is also provided for connection to a hose or another component such as an elbow 22. Outlet 20 is a full flow outlet having a diameter corresponding to that of passage 14. A valve 25 is interposed in passage 14 and may be a suitable control valve such as a ball valve or other valve having an external lever operator 28. In the position shown in FIG. 1, the lever is positioned transverse of flow passageway 14 and will block flow between inlet end 16 and outlet 20. If the lever is rotated 90° to a position in which the lever is in line with passageway 14, the valve will permit full flow between the inlet and outlet.

Figure 1:
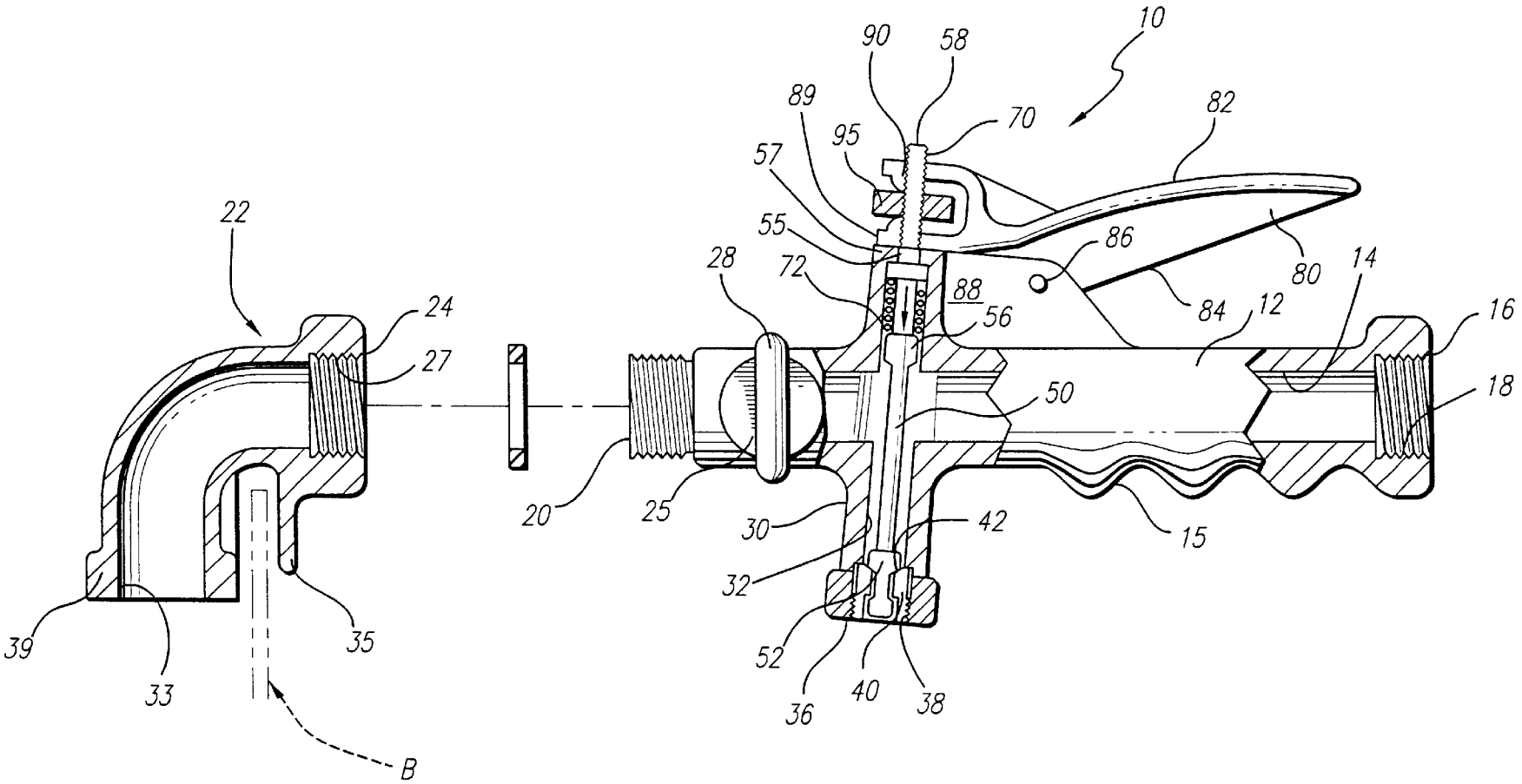
FIG. 1 is a side view, partly in section, of a preferred embodiment of the nozzle of the present invention.

A spray nozzle body 30 intercepts the main body 12 at an intermediate location between valve 25 and inlet end 16 and defines an axially-extending passageway 32 which is generally perpendicular with respect to the axis of passage 14 or may be angularly disposed thereto. The passageway 32 has an outlet 36 which is internally threaded at 38 to receive the spray nozzle 40 having a concave seat 42, as is conventional. A plunger 50 is axially reciprocal in passageway 32 and has a head 52 which, in the closed position, engages the seat 42. The opposite end of the plunger has an enlarged section 56. Section 58 of the plunger is in the form of a pin extending through a bore 55 and seal in the end 57 of the body 32. The outer, distal end of the shaft is threaded at 70. A biasing spring 72 extends between the enlarged collar 56 on the plunger 50 and the interior of end 57 to apply a biasing force in the direction of the arrow, normally urging the spray nozzle head 52 to the closed or flow-blocking position.

The spray nozzle is operable by means of a handle 80 which has a generally curved outer surface 82 and a web portion 84. The web portion 84 is pivotally connected at pivot pin 86 to a flange 88 which generally extends in the area of the intersection of the main body 12 and the spray nozzle body 32. The forward end of the handle is provided with a pair of generally spaced-apart flanges 89 and 90 which define a space therebetween. The flanges 89, 90 are provided with a bore to accept the threaded end of the shaft. An adjustment knob 95 is in threaded engagement with the threaded shaft intermediate the flanges and may be rotated to move the handle to a fixed, open position when spraying an area for a prolonged period of time with a selected pattern. A grip section 15 has alternating raised ribs and projections to comfortably receive the user's fingers when grasped with the palm engaging section 82 of the handle.

As mentioned previously, the discharge end 20 may be provided with a 90° elbow 22. The 90° elbow 22 has an inlet end 24 which is provided with female threads 27 which may be engaged about the male hose threads 28 at the outlet end 20. The elbow 22 has a discharge end 33 which when attached to the body 12 generally aligns or is co-axial with the discharge 36 of the spray nozzle. The elbow may be removed if it is desired to have the full flow outlet 20 at an axial location.

The elbow 22 is provided with a lip 35 which extends generally parallel to the collar about outlet 32 and is spaced from the outlet. Thus, the projection and enlarged collar 39 about the outlet define an area which can be hooked over the lip of a bucket "B" as shown in dotted in FIG. 1, which allows the device to be hung in a self-supporting position to free the hands of the user.

The fluid delivery device of the present invention may be fabricated from any suitable material such as ABS, PVC, styrene or the like. For example, the body may be molded or injection molded from a suitable plastic or may be fabricated from brass or bronze. The control valve and spray nozzle components may similarly be fabricated from suitable metal or plastic. The choice of materials will be determined in part by the manufacturing procedures to be utilized and the target selling price of the completed product. It may be that the product will be manufactured in several different materials to provide the consumer a lower cost plastic version and a higher cost metal version of the product.

Figure 2:
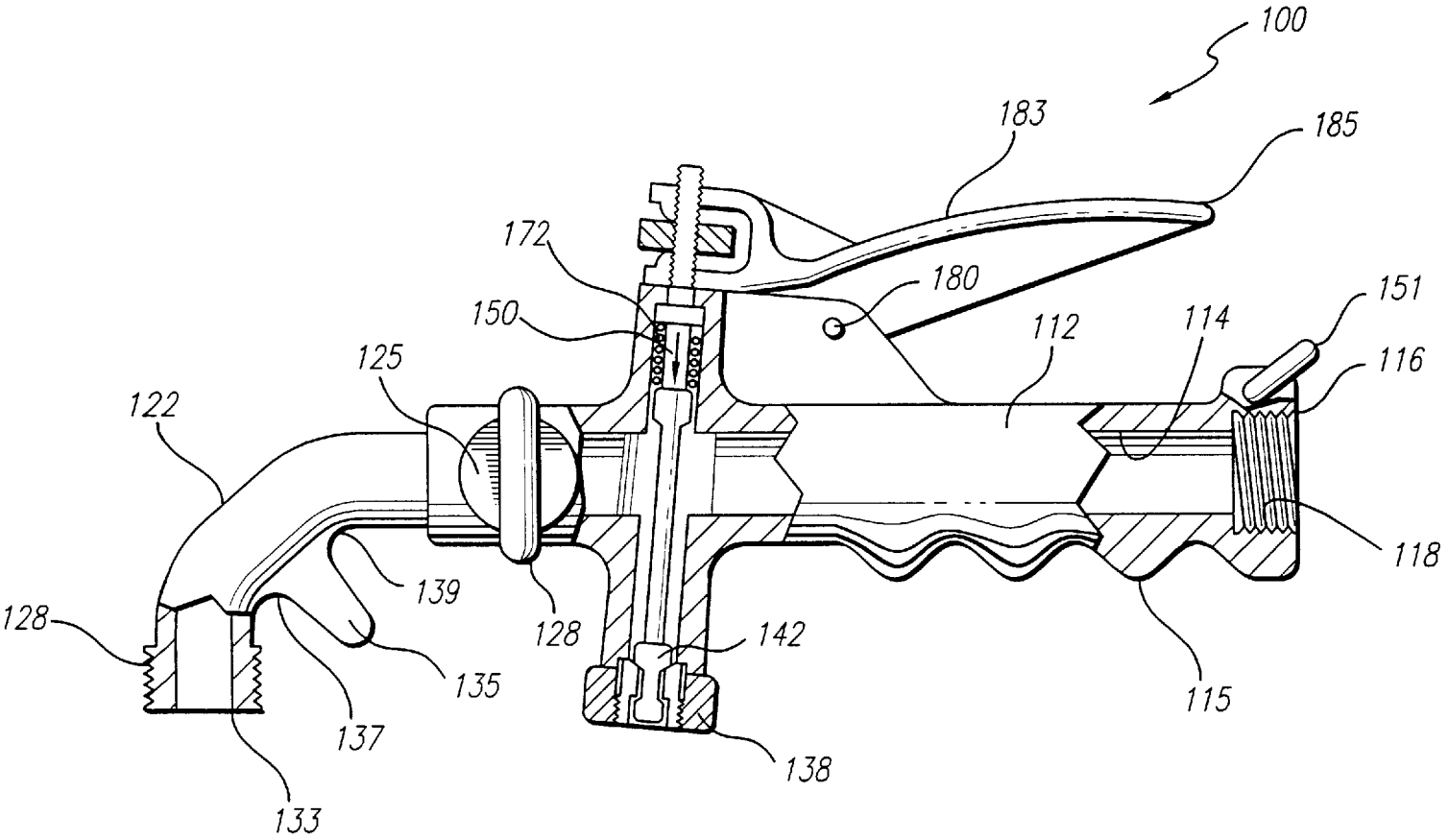
FIG. 2 is a view similar to FIG. 1 of an alternate embodiment in which the full flow outlet is provided with an integrally formed elbow.
Figure 3:
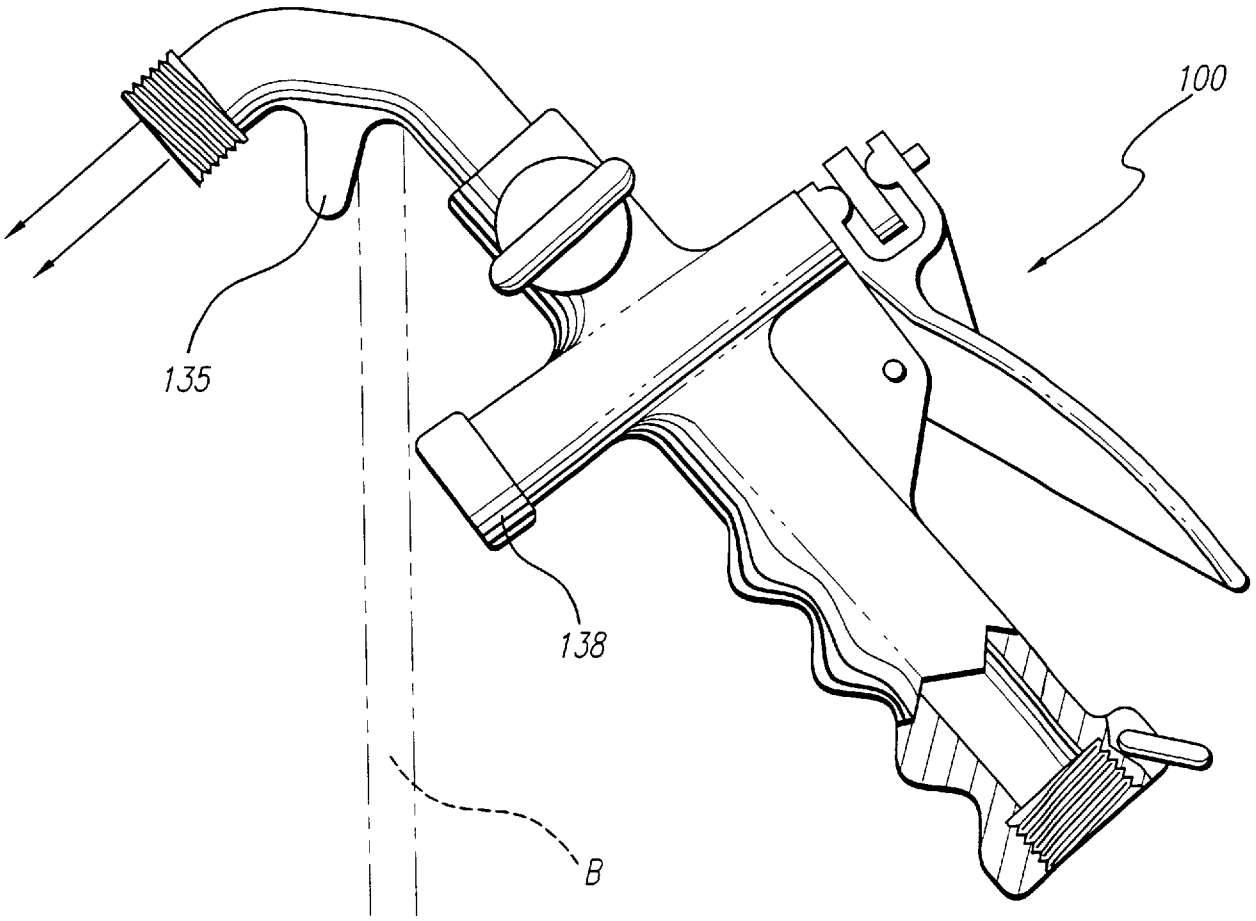
FIG. 3 shows the device of FIG. 2 positioned on a pail in a self-supporting position.

Turning to FIGS. 2 and 3, an alternate embodiment of the present invention is shown generally designated by the numeral 100. The embodiment 100 is generally constructed as has been described with FIG. 1 having main body 112 defining an axially extending passageway 114. Passageway 114 has an inlet 116 which is provided with internal standard female threads 118 for attachment to a hose. The exterior of the body is also provided with a grip section 115 which consists of alternating ridges and recesses to accommodate the fingers of the user.

Spray actuator 182 is pivotally connected to the body at pivot pin 180 and operates the plunger 150 against the spring biasing force applied by spring 172. Downward pressure against the exterior curved surface 183 of the actuator handle will cause the plunger to be lifted so that the value member 142 is unseated to allow a spray to emanate from the nozzle 138. The position of the spray actuator will determine the flare angle of the spray as is well known.

A control valve 125 is provided in passageway 114 and when rotated to the flow-blocking position shown, will allow all of the fluid delivered to passageway 114 to be available to be discharged at the spray nozzle. If, on the other hand, the user requires a full flow discharge, the control valve 125 will be rotated to the open position by means of actuating lever 128. In this position, all of the fluid delivered to the inlet 116 will then be delivered to discharge 133 which is formed as part of integrally-formed elbow section 122. The discharge 133 is substantially co-axial with the discharge of the spray nozzle so the user can grasp the device in pistol grip fashion to direct a stream or spray pattern of fluid to a target area. The exterior of the discharge may be provided with standard male hose threads 128 so that the nozzle may be connected to another hose without the user having to remove the device.

A wire catch or bail 151 is shown pivotally secured to the inlet and may be locked over the tip 185 of the handle to lock the actuator of the spray nozzle in a full open position, if desired.

In addition, projection 135 extends angularly from the body in the area of elbow 122 depending outwardly as shown. A pair of generally arcuate recesses 137 and 139 are provided on opposite sides of the projection and allow the fluid delivery device to be easily suspended from the edge of a container such as a bucket "B" shown in FIG. 3. In this position, the outlet end 138 of the spray nozzle will engage the side of the bucket to further brace it. The user then simply opens the control valve to allow full flow of fluid to be discharged into the bucket to rapidly fill the bucket.

Thus, from the foregoing, it will be seen that the spray device of the present invention is simple and versatile and retains all of the functional features of conventional spray nozzle and additionally affords the user the ability to discharge a full flow stream for filling containers or flood irrigating an area. The device is ergonomically designed and allows the user the convenience of actuation of the spray nozzle by simply grasping the device and depressing the actuator lever. The grip portion on the body provides a comfortable natural pistol-like surface for the user's hand. The device allows additional hoses to be attached without the necessity of removing the device as is necessary with conventional spray nozzles. The configuration of the device also accommodates hands-free use when filling a bucket or container as the device may be hung or suspended from the edge of container at projections integrally provided on the device.

The discharge may be full flow water outlet or discharge and is preferably oriented so that it is co-axial with the spray discharge. However, the full flow water outlet may be provided either as part of an integral elbow formed in the device or as a removable elbow in which case the user may remove the elbow if an axial, full flow discharge is preferred.

While the principles of the invention have been made clear in the illustrative embodiments set forth above, it will be obvious to those skilled in the art to make various modifications to the structure, arrangement, proportion, elements, materials and components used in the practice of the invention. To the extent that these various modifications do not depart from the spirit and scope of the appended claims, they are intended to be encompassed therein.

I claim:

1. A fluid delivery device attachable to a fluid supply for delivering either a spray or a full flow stream, said device comprising:

(a) a first body having an inlet and an outlet end interconnected by a first fluid passageway, said outlet end being disposed generally normal to the passageway and being provided with male hose threads;

(b) a flow control valve interposed in said passageway for selectively controlling flow between said inlet and said outlet end;

(c) a second body intercepting said first body and defining a second fluid passageway intercepting said first fluid passageway at a location between said control valve and said inlet;

(d) a spray nozzle at the outlet of said second passageway disposed generally co-axially with respect to said outlet end; and (e) actuator means for selectively placing said spray nozzle in communication with said second passageway whereby the user may selectively operate said flow control valve and said actuator means to deliver either a discharge spray at said spray nozzle or a stream at said outlet end.

2. The fluid delivery device of claim 1 wherein said actuator means includes a handle pivotally secured to said body.

3. The fluid delivery device of claim 2 wherein said handle has an exterior generally arcuate curved surface and wherein said first body is provided with finger grip means disposed generally opposite said curved surface whereby the device can be grasped in a pistol-like manner.

4. The fluid delivery device of claim 3 wherein said body is provided with a locking means engageable with said spray actuator handle.

5. The fluid delivery device of claim 1 wherein said body is provided with projection means engageable about the lip of a container to secure said fluid delivery device in a self-supporting position with the outlet directed to the interior of the container.

6. The fluid delivery device of claim 1 wherein said body and said spray body are integrally molded from plastic.

7. The fluid delivery device of claim 1 wherein said actuator means includes an axially extending plunger within said second fluid passageway, spring means biasing said plunger to a closed position and adjustment means engageable with said plunger and said handle to adjust the position of the spray nozzle.

8. A fluid delivery device attachable to a fluid supply for delivering either a spray or a full flow stream, said device comprising:

(a) a first body having an inlet and an outlet end interconnected by a first fluid passageway, said outlet end being disposed generally normal to the passageway, said outlet end being in threaded engagement with said first body;

(b) a flow control valve interposed in said passageway for selectively controlling flow between said inlet and said outlet end;

(c) a second body intercepting said first body and defining a second fluid passageway intercepting said first fluid passageway at a location between said control valve and said inlet;

(d) a spray nozzle at the outlet of said second passageway disposed generally co-axially with respect to said outlet end; and (e) actuator means for selectively placing said spray nozzle in communication with said second passageway whereby the user may selectively operate said flow control valve and said actuator means to deliver either a discharge spray at said spray nozzle or a stream at said outlet end.

* * * * *